US008562165B2

(12) United States Patent
Thompson et al.

(10) Patent No.: US 8,562,165 B2
(45) Date of Patent: Oct. 22, 2013

(54) PRESSURE ACTIVATED LIGHTED GLOVE

(76) Inventors: Justin Thompson, Duncan Falls, OH (US); Timothy L. Matheney, II, Zanesville, OH (US)

( * ) Notice: Subject to any disclaimer, the term of this patent is extended or adjusted under 35 U.S.C. 154(b) by 158 days.

(21) Appl. No.: 12/912,413

(22) Filed: Oct. 26, 2010

(65) Prior Publication Data

US 2011/0258752 A1 Oct. 27, 2011

Related U.S. Application Data

(63) Continuation-in-part of application No. 12/360,580, filed on Jan. 27, 2009, now Pat. No. 7,819,544.

(60) Provisional application No. 61/133,082, filed on Jun. 26, 2008.

(51) Int. Cl.
*F21V 21/08* (2006.01)

(52) U.S. Cl.
USPC ..... 362/103; 362/184; 362/249.05; 362/802; 2/160; 250/504 H

(58) Field of Classification Search
USPC ..... 362/103, 109, 184, 249.05, 802; 2/160; 250/504 H
See application file for complete search history.

(56) References Cited

U.S. PATENT DOCUMENTS 3,961,175 A 6/1976 Otagoshi
3,971,028 A 7/1976 Funk
4,215,389 A 7/1980 Colangelo
4,304,825 A 12/1981 Basau
4,355,309 A 10/1982 Hughey et al.
4,398,237 A 8/1983 Doyel
4,422,131 A 12/1983 Clanton et al.
4,625,339 A 12/1986 Peters
4,873,160 A 10/1989 Miyazaki et al.
4,977,489 A 12/1990 Fung
4,996,128 A 2/1991 Aldecoa et al.
5,041,825 A 8/1991 Hart et al.
5,124,892 A 6/1992 Lambert
5,154,506 A 10/1992 Leard
5,177,467 A 1/1993 Chung-Piao
5,192,126 A 3/1993 Remeyer et al.
5,255,167 A * 10/1993 Toussaint et al. ..... 362/103
5,283,722 A 2/1994 Koenen et al.
5,345,368 A 9/1994 Huff
5,449,567 A 9/1995 Yeh
5,535,105 A 7/1996 Koenen et al.
5,919,589 A 7/1999 Kawakami et al.
6,006,357 A 12/1999 Mead
D423,758 S 5/2000 Jones
6,290,367 B1 9/2001 Greenhoe et al.
6,592,235 B1 7/2003 Mayo
6,892,397 B2 5/2005 Raz et al.
7,013,490 B2 * 3/2006 Senter et al. ..... 2/160

(Continued)

OTHER PUBLICATIONS

Blackhawk Protective Gear, packaging insert, Revised Nov. 2007.

(Continued)

*Primary Examiner* — Stephen F Husar
(74) *Attorney, Agent, or Firm* — Standley Law Group LLP

(57) ABSTRACT

Exemplary embodiments comprise a lighted glove with an infra red light source which can be activated by applying a force to a pressure sensor that is in electrical communication with the light source. Exemplary embodiments are useful in night vision applications.

19 Claims, 18 Drawing Sheets

(56) References Cited

U.S. PATENT DOCUMENTS

| | | | | |
|---|---|---|---|---|
| 7,152,248 | B2 | 12/2006 | Ziemer | |
| 7,819,544 | B2 * | 10/2010 | Thompson et al. | 362/103 |
| 2001/0048596 | A1 | 12/2001 | Kerr | |
| 2005/0207196 | A1 | 9/2005 | Holmes et al. | |
| 2008/0062676 | A1 | 3/2008 | Masuda | |
| 2008/0218996 | A1 * | 9/2008 | Galloway et al. | 362/103 |

OTHER PUBLICATIONS

Cabela's ULH LED Clip Light, webpage copyrighted 1996-2008, 2 pages, retreived at http://www.cabelas.com/cabelas/en/templates/link . . . p.form23&__dyncharset=ISO-8859-1&__requestid=76334 on Feb. 9, 2009.

NightVisionExperts.com—All Night Vision Lighting, "Snapshot Review All Night Vision Lighting", NightVisionExperts.com—a division of Simon's Smokehouse Inc. Buffalo, USA copyright 1999-2010. 2 pages, Retrieved Oct. 26, 2010. http://www.nightvisionexperts.com/snapshot-all-lighting.htm.

Morovision Night Vision, Inc., "How Night Vision Works," copyright 2000-2010, 4 pages, retrieved Oct. 26, 2010, http://www.morovision.com/hownightvisionworks.htm.

American Technologies Network Corp, "How Night Vision Works," San Francisco, CA, copyright 2000-2010, 3 pages, retrieved Apr. 17, 2013. http://www.atncorp.com/hownightvisionworks.

* cited by examiner

PRESSURE ACTIVATED LIGHTED GLOVE

CROSS REFERENCE TO RELATED APPLICATIONS

This application is a continuation in part of U.S. Ser. No. 12/360,580 filed Jan. 27, 2009, now U.S. Pat. No. 7,819,544 which is a non-provisional of U.S. Application No. 61/133,082 filed Jun. 26, 2008, each of which are hereby incorporated by reference in their entirety.

TECHNICAL FIELD

Exemplary embodiments relate generally to a lighting device. More particularly, embodiments relate to a glove equipped with a light source that can be activated and deactivated through the application of pressure to a pressure sensor that is attached to or located within the glove.

BACKGROUND AND SUMMARY OF THE INVENTION

In certain professions and hobbies, individuals must be prepared to handle poorly lit conditions on short notice. Thus, it has become customary for many individuals to carry flashlights on a day to day or at least on a regular basis. Though advances in technology have permitted flashlights to be minimized in size, it is still often inconvenient to juggle a traditional flashlight as well as other devices that may be required by the task at hand.

Take for example the profession of law enforcement. Officers of the law must often work in the dark under dangerous conditions: a combination that has made flashlights integral to officer safety. Unfortunately, using one hand for the purpose of carrying and operating a flashlight has often times interfered with other important law enforcement tasks such as firing a gun, calling for reinforcement using a radio or telephone, setting off tear gas, operating a bike or other vehicle, etc. A device such as a lighted glove, which could permit law enforcement officials to combat poorly lit conditions without interfering in the officers' other operations would intuitively be well received by this demographic.

Lighted gloves are not new to the art. Examples of typical lighted gloves may be found in U.S. Pat. Nos. 7,152,248, 6,592,235, 5,345,368, 5,283,722, 5,154,506, 5,124,892, 4,625,339, 5,535,105, 6,006,357, 6,892,397, 4,422,131, and D423758, all of which are hereby incorporated by reference. Among the problems with the lighted gloves existing in the art, and the most probable reason their use has not become wide spread among individuals such as police officers, is the fact that they can not be operated in a way that actually frees up hand space nor can their light sources be activated and deactivated quickly. In order to activate the light source on one of the existing lighted gloves, a user must use his non-gloved hand to find and then push the light's activation/deactivation button. This can be especially burdensome if both of the officer's hands are in gloves; bulky glove fabric makes manually turning a light on and off more difficult.

The currently disclosed pressure-activated lighted glove solves many of the problems that have plagued preexisting lighted gloves. In one exemplary embodiment, the lighted glove is activated and deactivated by applying pressure to the palm of the glove. In this exemplary embodiment, the applied pressure can be detected by a pressure sensor that has been inserted in the glove's palm. The sensor, can convert the detected pressure into a signal which is then sent to a power source for the glove's light source. Upon receiving the signal, the power source can cause the light source to be turned on or off. In some exemplary embodiments, there is one light source per glove. In other exemplary embodiments, there is more than one light source per glove. In a preferred exemplary embodiment, a pressure activated lighted glove has one light source that is located on the back side of the user's hand while the user is wearing the glove. A light source of the presently disclosed lighted glove may be an LED, but many light sources can be used in practicing the invention.

Another exemplary embodiment of a pressure activated lighted glove comprises a three way switch that works in conjunction with a pressure sensor. In a preferred embodiment, the three way switch has the following three settings: pressure activation, light on, and light off. When the switch is set to "pressure activation", the pressure sensor can be used to turn the glove's light on and off. When the switch is set to "light on" the glove's light is activated independently of the pressure-activation pad. When the switch is set to "light off" the glove's light is deactivated and the only way to turn it on is to turn the switch to one of its other two settings. In some exemplary embodiments the pressure activated glove has a switch with more or less than three settings.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION

Figure 1:
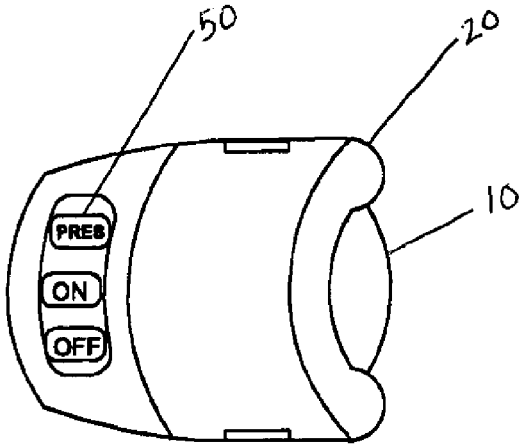
FIG. 1 shows a perspective view of an exemplary embodiment of a light source and a pressure sensor bypass means that may be used in a pressure activated lighted glove.

An exemplary embodiment of a pressure activated lighted glove 200 comprises a glove 100, a light source 10, a means for attaching 20 the light source to the glove, a power source 30 in electrical communication with the light source 10, a pressure sensor 40 attached to the glove 100 that is capable of detecting an applied force, and a pressure sensor bypass means 50. In a preferred exemplary embodiment the utilized glove 100 is both heat and water resistant. An example of such a glove 100 is the Fury Commando glove sold by BLACKHAWK PRODUCTS GROUP. This type of glove 100 is commonly referred to as a tactical glove. Tactical gloves are common and well-known to the art and there are numerous varieties of tactical gloves that could be used in practicing a pressure activated lighted glove 200. In some exemplary embodiments, the outer surface of the glove 100 has been treated with leather or another material to enhance the user's ability to get a grip while wearing the glove. Upon reading this disclosure, it would be clear to one skilled in the art that there are many glove and material variations that would work for the purposes of practicing the currently disclosed pressure activated lighted glove 200.

Figure 5:
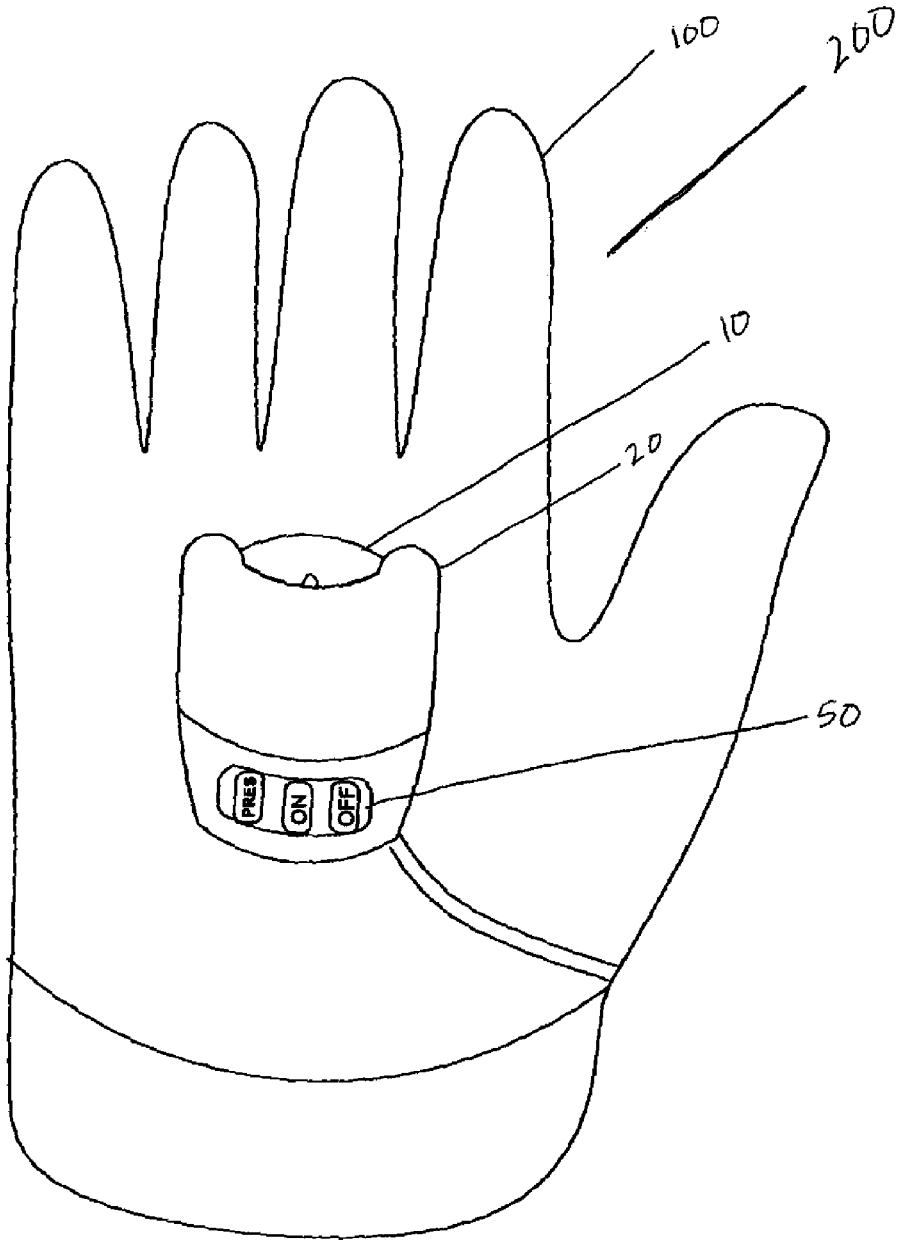
FIG. 5 shows a top plan view of an exemplary embodiment of a pressure activated lighted glove utilizing the exemplary light source of FIG. 1.

A pressure activated lighted glove 200 comprises a light source 10. FIGS. 1-4 each show an exemplary embodiment of a light source 10 that may be used in a pressure activated lighted glove 200. FIG. 5 shows an exemplary embodiment of how a light source 10 may be affixed to a glove 100 in order to form a pressure activated lighted glove 200. In a preferred exemplary embodiment, the light source 10 is a light-emitting diode ("LED") light source that emits white light under the application of an electric current. The light-emitting diode light source could emit white light by utilizing individual LEDs that emit three primary colors—red, green, and blue—and mixing all of the colors to produce white light. This method of producing white light is commonly referred to as multi-colored white LED. In another exemplary embodiment, phosphor material could be used to convert monochromatic light from a blue or ultra violet LED into broad spectrum white light (this is very similar to the way fluorescent bulbs work). In other exemplary embodiments, the light source 10 is an LED that emits a color of light other than white. The light source 10 may also be of a type other than a LED. For example, a traditional light bulb may be utilized. Some embodiments may utilize a light source 10 capable of putting out light of varying intensities.

In one exemplary embodiment, the light source 10 emits infra red light which is not visible by the naked eye. In an exemplary embodiment where the light source 10 emits infra red light, a user of the glove may be able to utilize the glove for nighttime surveillance. For example, a user may be able to activate the infra red light source 10 of the glove and illuminate a desired area with the light. Though the infra red light cannot be seen by the naked eye alone, the user of the glove may implement a night vision tool which permits him or her to see the area which has been illuminated with the infra red light emitted by the light source 10. Night vision tools which detect infra red light are not new to the art. Examples of night vision tools which may be utilized in conjunction with an infra red emitting lighted glove include but are not limited to night vision monoculars, night vision goggles, night vision binoculars, night vision weapon sights, etc. Examples of some of these devices can be found at www.atncorp.com the disclosure of which is hereby incorporated by reference.

One exemplary embodiment comprises a glove 100, an infra red light source 10, a means for attaching 20 the light source 10 to the glove 100, a power source 30 in electrical communication with the light source 10, a pressure sensor 40 attached to the glove 100 that is capable of detecting an applied force, and a pressure sensor bypass means 50. A user may implement a night vision tool 300 with the glove. In such an exemplary embodiment, the user may activate the infra red light of the glove 100 by applying pressure to the pressure sensor 40. The user may then direct the infra red light at a desired area which may be seen by the user the night vision tool 300.

In exemplary embodiments where the glove comprises an infra red light source and a means for attaching the infra red light source to the glove, the infra red light source may be selectively connected to and disconnected from the glove via the attachment means 20. The attachment means 20 may be a light socket. When an infra red light may be selectively connected to and disconnected from a glove 100 via an attachment means 20, other light sources that do not emit infra red light may also be utilized with the glove. For example an attachment means 20 may be able to connect an infra red light source to a glove 100 but it may also be utilized to connect a non infra red light, such as an incandescent light, to the glove 100. In these exemplary embodiments a lighted glove that may be implemented with a night vision tool may not be limited to such uses.

In one exemplary embodiment, the light source 10 of a pressure activated lighted glove 200 is attached to the glove 100 by an attachment means 20. The attachment means 20 may be a casing capable of holding the light source in place. In a preferred embodiment, the attachment means 20 is a casing made of a polymeric material. FIG. 1, FIG. 2, FIG. 3, and FIG. 4 each show an exemplary embodiment of a light source 10 within an exemplary embodiment of a casing that has been made of a polymeric material. In some embodiments, a casing may be used to store the glove's light source 10, power source 30, and pressure sensor bypass means 50. In some exemplary embodiments the attachment means 20 is actually part of the glove's light source 10.

The attachment means 20 may be attached to a pressure activated lighted glove 200 in a variety of ways; for example a casing may be sewn to the glove 100 but it may also be attached to the glove 100 using an adhesive. In one exemplary embodiment, a casing acts as a docking for the glove's light source 10. Thus, the light source 10 can be placed into the docking and operated from the casing's location on the glove 100 but the light source 10 could also be utilized outside of the glove's docking. In some exemplary embodiments, the light source 10 could be removed from the casing that is attached to the glove 100 and attached to another part of the user's body but still be activated and deactivated using the pressure sensor located on the glove 100.

In one exemplary embodiment, a light source 10 that is removed from the attachment means 20 and positioned on another part of the user's body is capable of receiving signals from the glove 100. In a preferred embodiment, the received signals are generated from the glove's pressure sensor 40 upon detecting an applied force. The signal could be an electronic signal that is transmitted through an electrical wire that travels from the glove 100 to the light source 10, but could also be a signal such as a radio signal that is transmitted without a wire through the air that separates the glove 100 and the light source 10. Sending a signal through the air to activate a light source 10 is not new to the art. Such a system can be found in U.S. Pat. Nos. 3,971,028, 5,041,825, 5,192,126, 4,355,309 all of which are hereby incorporated by reference. In exemplary embodiments where the light source 10 can be removed from the attachment means 20 and still operated, it will be necessary for a power source 30 to remain in electrical communication with the light source 10. Thus, the light source 10 could be contained within a casing that is not the attachment means 20 where the casing also houses the power source.

In another exemplary embodiment, an attachment means 20 for a light source 10 is a band of fabric that holds the light source 10 in place. The attachment means 20 could also be an adhesive such as glue. In other exemplary embodiments the attachment means 20 is a wiring configuration that secures the light's location on the glove 100. There are numerous attachment means 20 capable of attaching the light source 10 to the glove 100 in order to form a pressure activated lighted glove 200.

Figure 2:
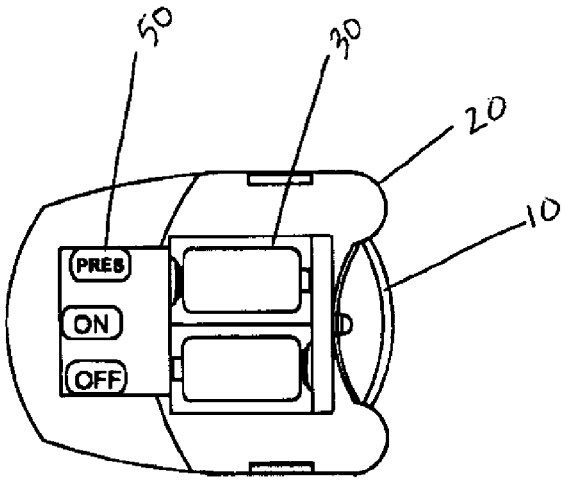
FIG. 2 shows a top plan view of the exemplary embodiment of FIG. 1 with part of the casing removed to show an exemplary embodiment of a power source.
Figure 3:
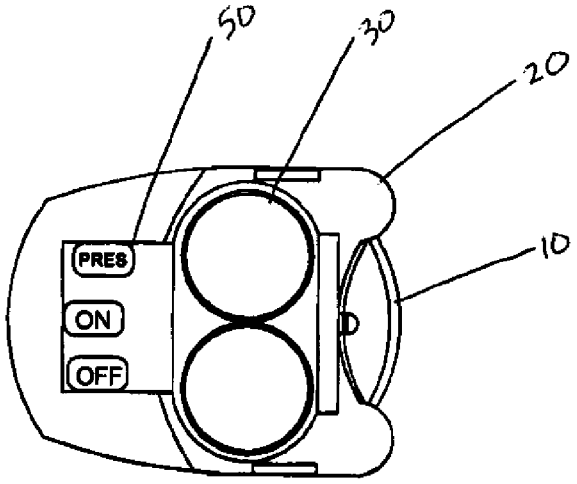
FIG. 3 shows a top plan view of the exemplary embodiment of FIG. 1 with part of the casing removed to show a second exemplary embodiment of a power source.
Figure 4:
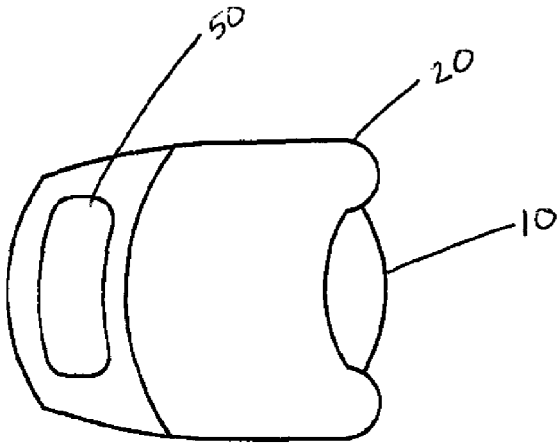
FIG. 4 shows a perspective view of a second exemplary embodiment of a light source that may be used in a pressure activated lighted glove.

The currently disclosed pressure activated lighted glove 200 comprises a power source 30. In some exemplary embodiments, such as is shown in FIG. 2, the power source 30 is batteries. The use of batteries to provide power to a light source 10 is well known in the art and is shown in U.S. Pat. Nos. 4,215,389, 4,398,237, 3,961,175, 4,977,489, and U.S. application Ser. No. 10/708,717 all of which are hereby incorporated by reference. In some exemplary embodiments, the power source 30 may be a rechargeable battery. The rechargeable battery may be rechargeable via a mechanism that plugs into a DC outlet. Rechargeable batteries are not new to the art. A typical rechargeable battery is disclosed by U.S. Pat. Nos. 4,996,128, 4,304,825, 5,919,589, 4,873,160, and 5,449,567 all hereby incorporated by reference. In other exemplary embodiments, the power source 30 may be recharged using energy from the sun. An example of a light source 10 powered by a battery that uses solar power to recharge is found in U.S. Pat. No. 6,290,367 which is hereby incorporated by reference. It is obvious to one skilled in the art upon reading this disclosure that many different types of power sources 30 could be used to make a pressure activated lighted glove 200.

Figure 6:
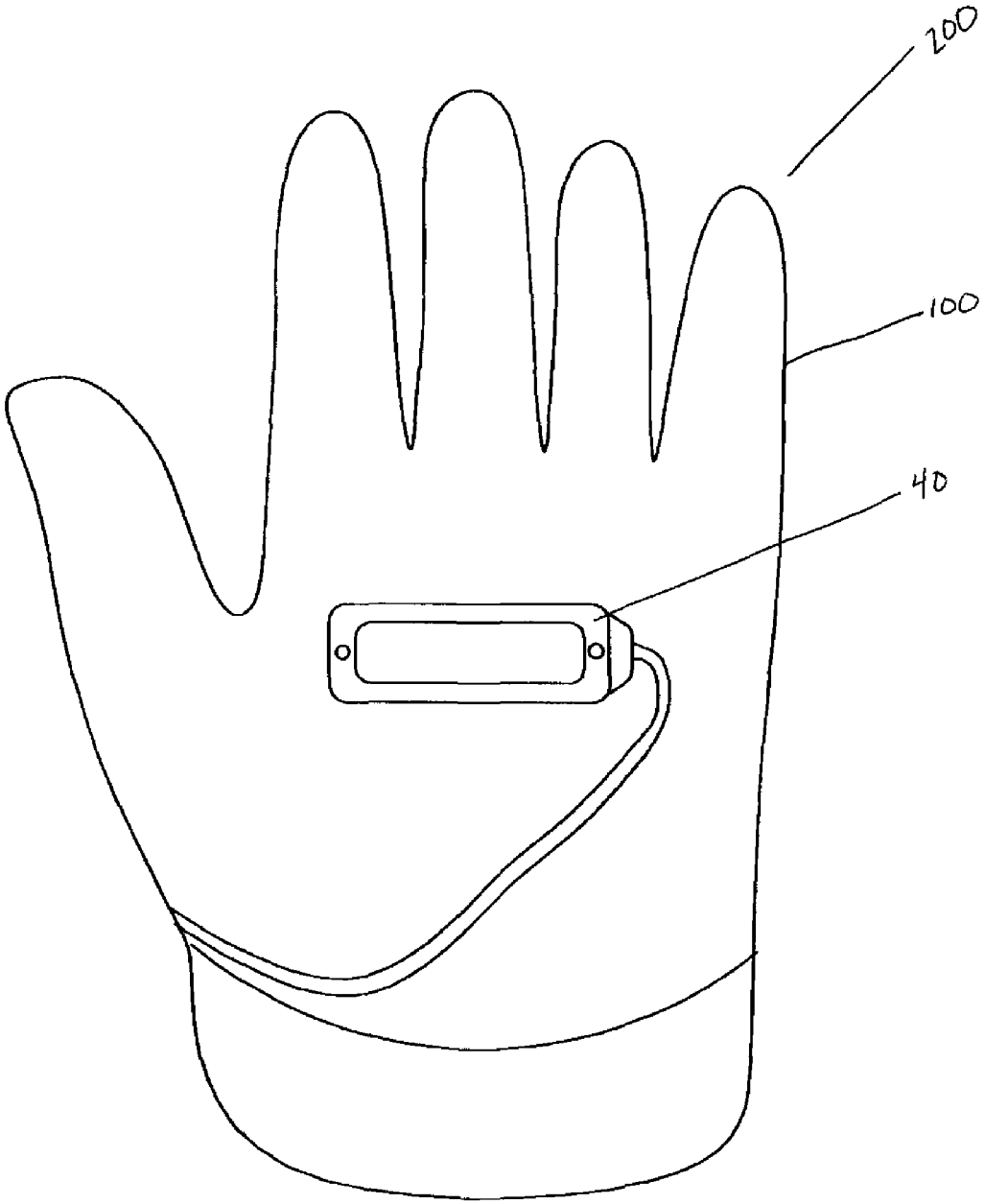
FIG. 6 shows a bottom plan view of the exemplary embodiment of FIG. 5 shown utilizing an exemplary embodiment of a pressure-activation pad.
Figure 7:
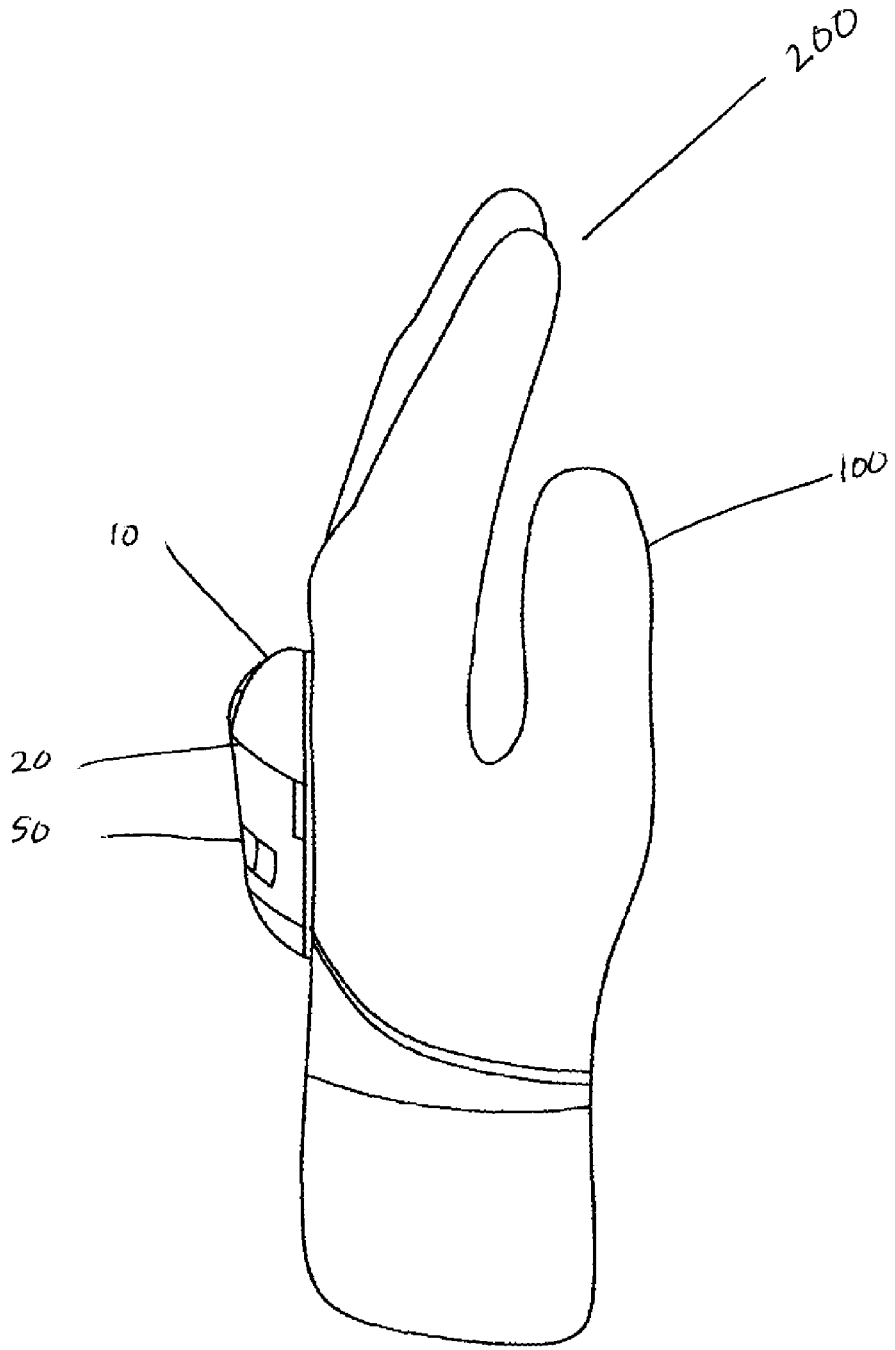
FIG. 7 is a side elevation view of the exemplary embodiment of FIG. 5.
Figure 8:
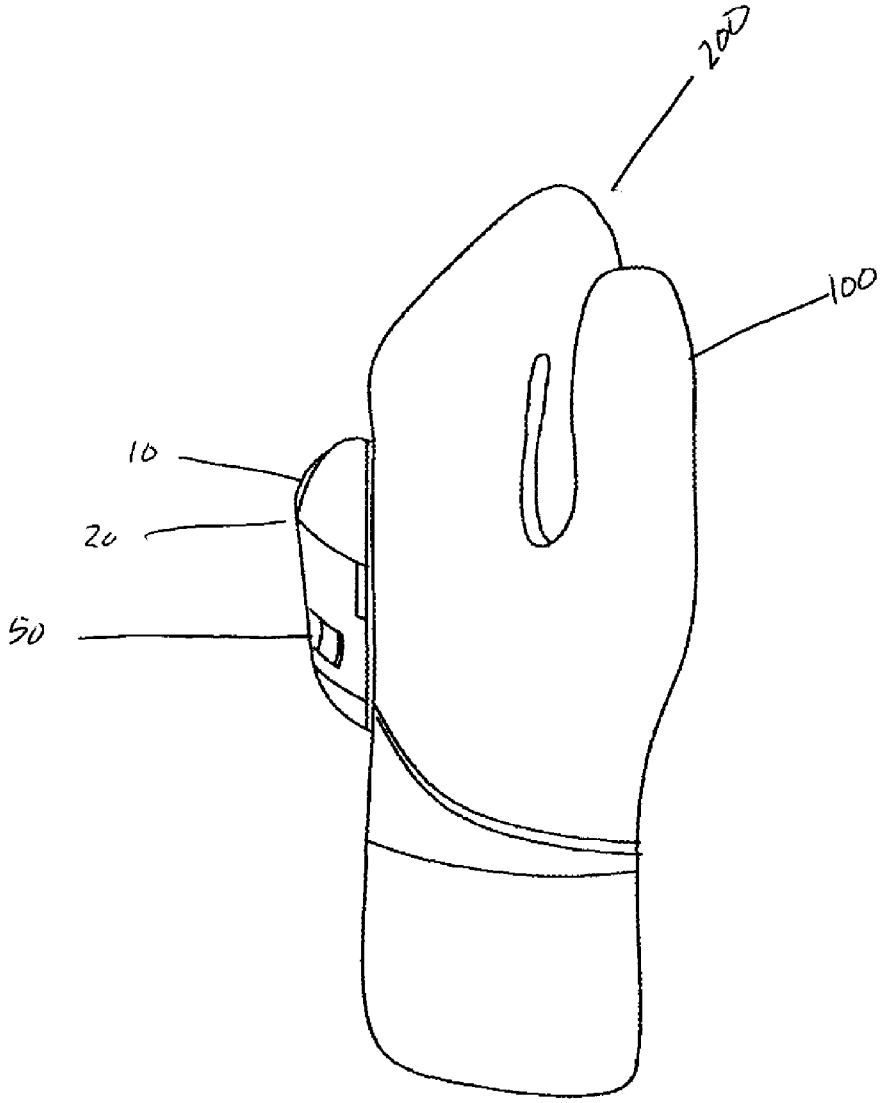
FIG. 8 is a side elevation view of the exemplary embodiment of FIG. 5 showing the glove in a closed-fisted position.
Figure 9:
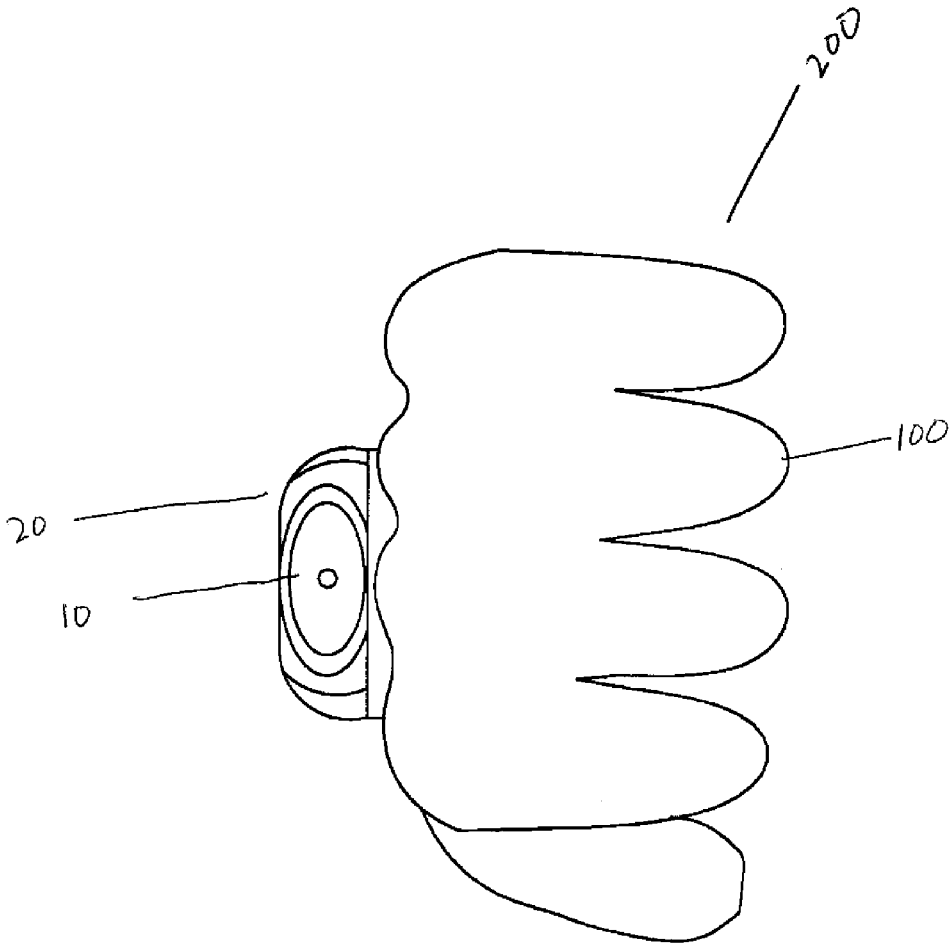
FIG. 9 is a front elevation view of the exemplary embodiment of FIG. 5 showing the glove in a closed-fisted position.

A pressure activated lighted glove 200 additionally comprises a pressure sensor 40. In a preferred exemplary embodiment, the pressure sensor 40 is a pad shaped device that is physically attached to the palm of the glove 100. FIG. 6 shows an exemplary embodiment of a pressure sensor 40 which has been affixed to the palm portion of a glove 100 in order to form a pressure-activated lighted glove 200. FIG. 7 and FIG. 8 each show an exemplary embodiment of a wire that may be utilized in forming a connection between the glove's pressure sensor 40 and light source 10. In some exemplary embodiments, the pressure sensor 40 is attached to the outer surface of the glove 100 while in other exemplary embodiments, the sensor 40 is encased by layers of the glove's fabric. In some embodiments, the sensor 40 is encased by waterproof material so that the sensor 40 is protected when the glove 100 is utilized in damp conditions. In some exemplary embodiments, the pressure sensor 40 of a pressure activated lighted glove 200 is located on one of the glove's fingers. In other exemplary embodiments a pressure sensor 40 can be located on any one of the glove's surfaces. Additionally, some exemplary embodiments may utilize more than one pressure sensor 40.

Figure 10:
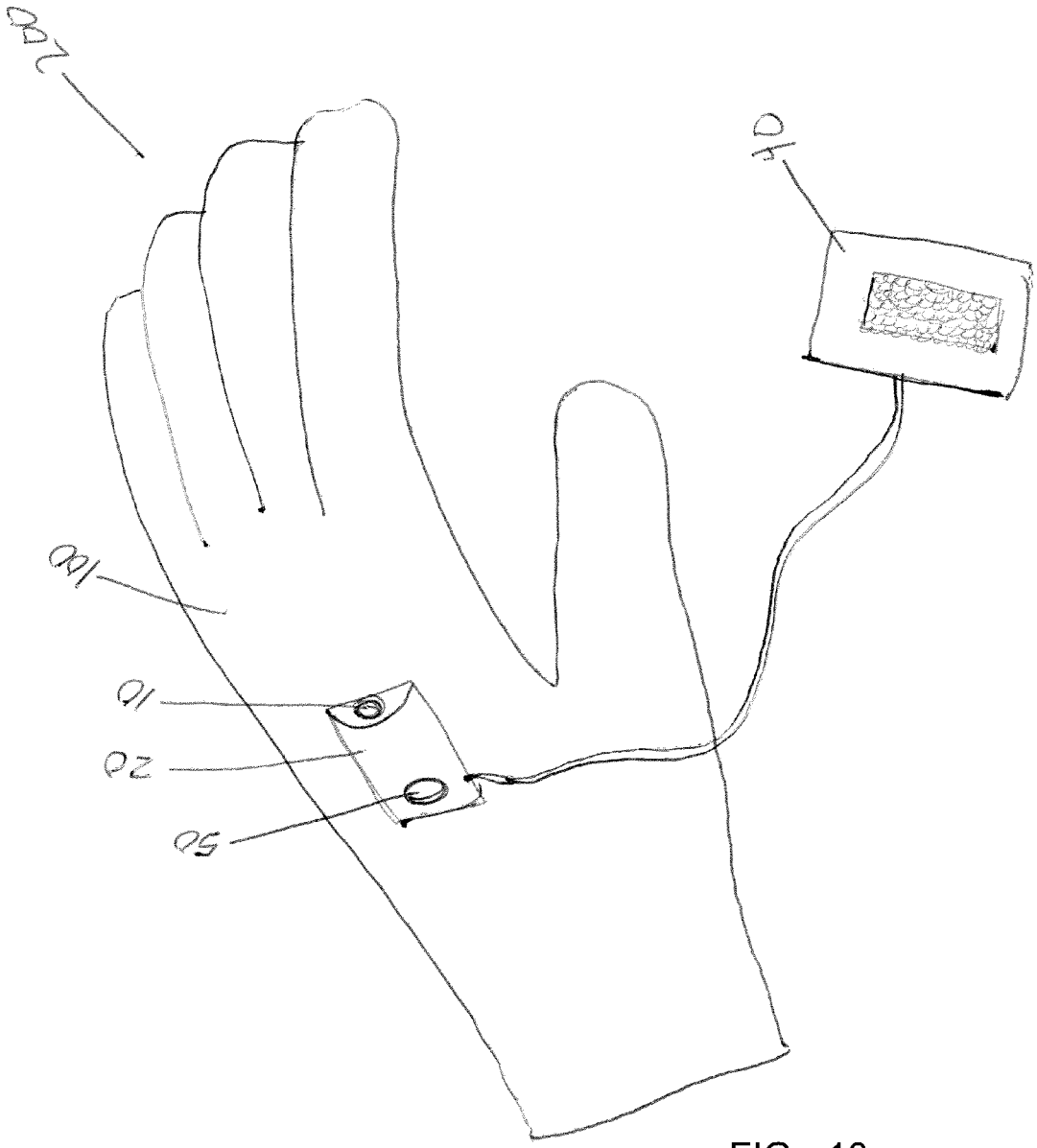
FIG. 10 shows a top elevation view of an exemplary embodiment comprising a pressure sensor that may be selectively connected to the glove in a variety of positions via Velcro.
Figure 11A:
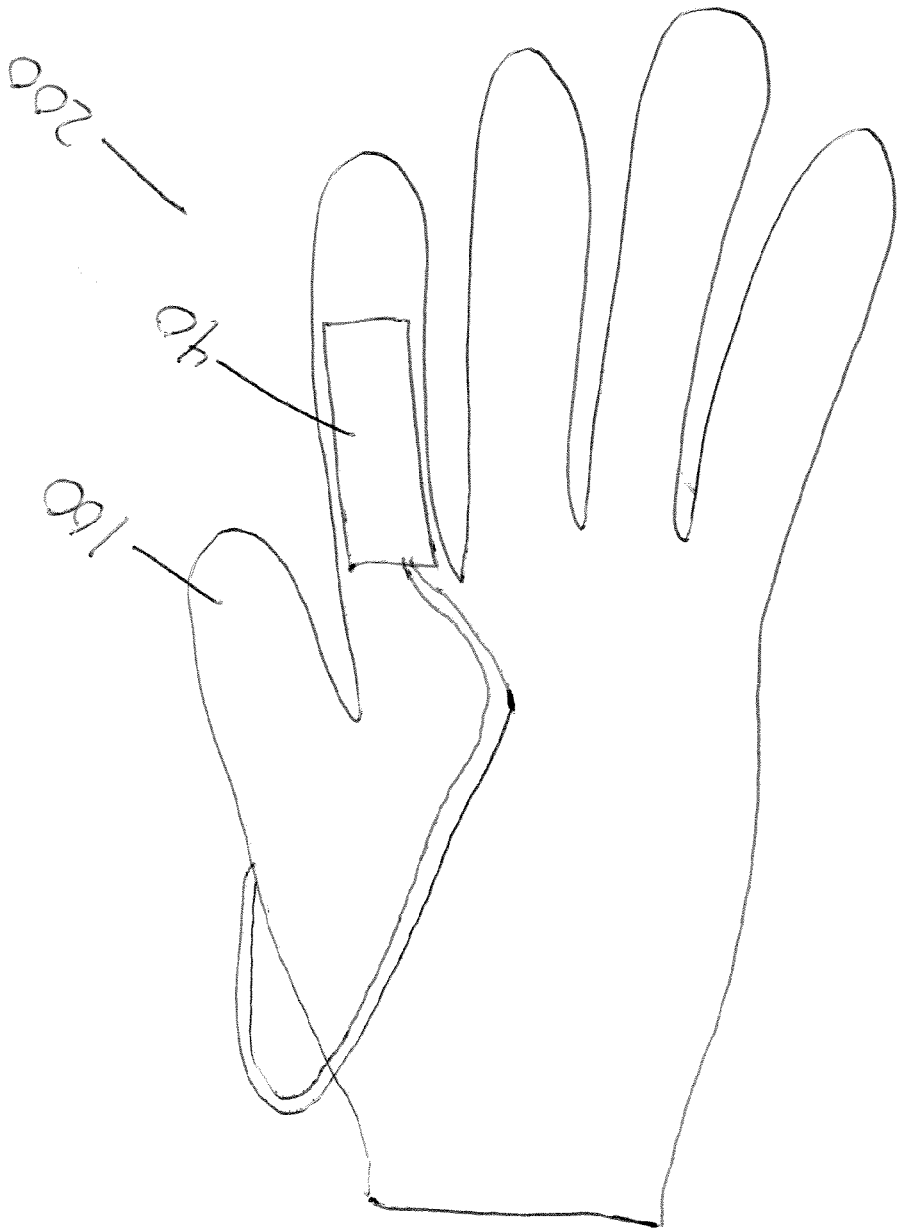
FIG. 11*a* shows a bottom plan view of a pressure sensor selectively connected to a glove via Velcro in a first position.
Figure 11B:
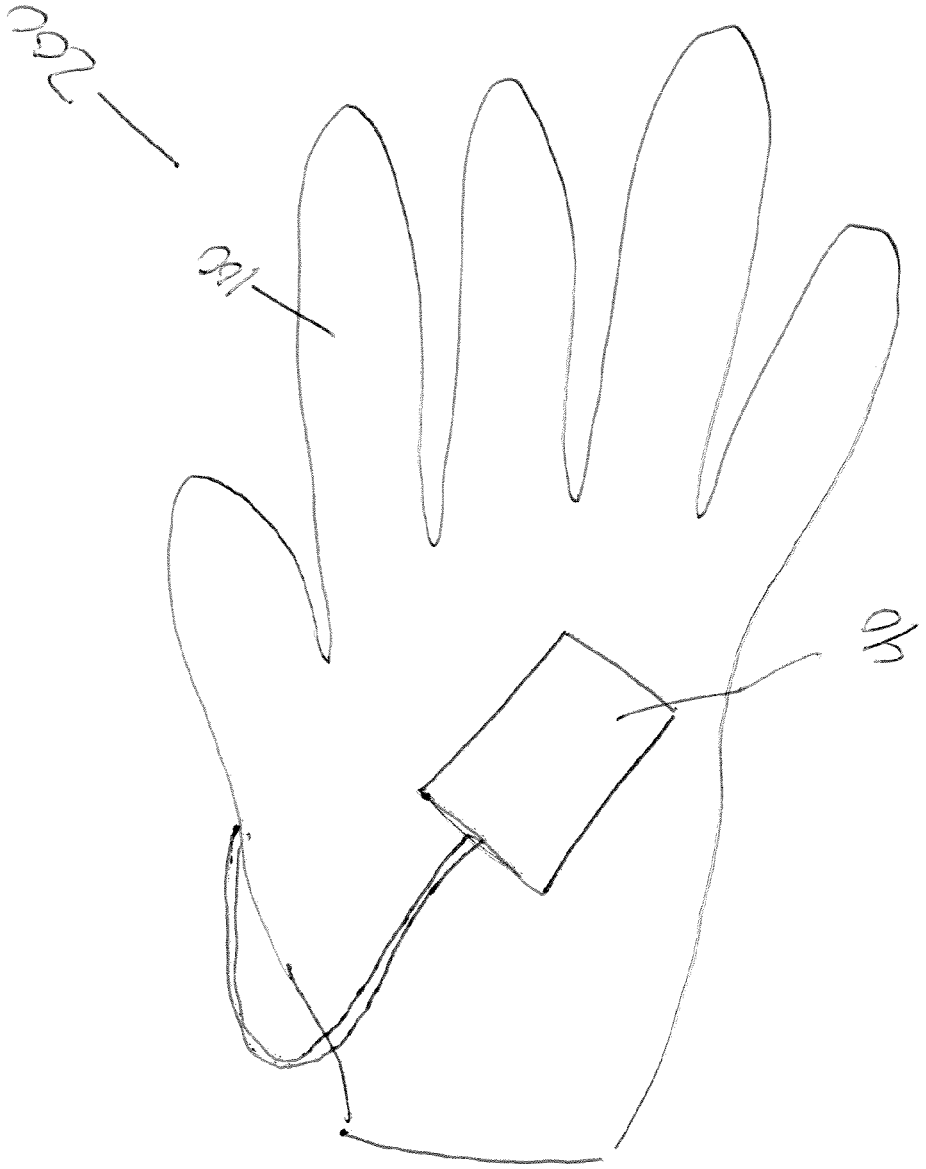
FIG. 11*b* shows a bottom plan view of a pressure sensor selectively connected to a glove via Velcro in a second position.
Figure 12:
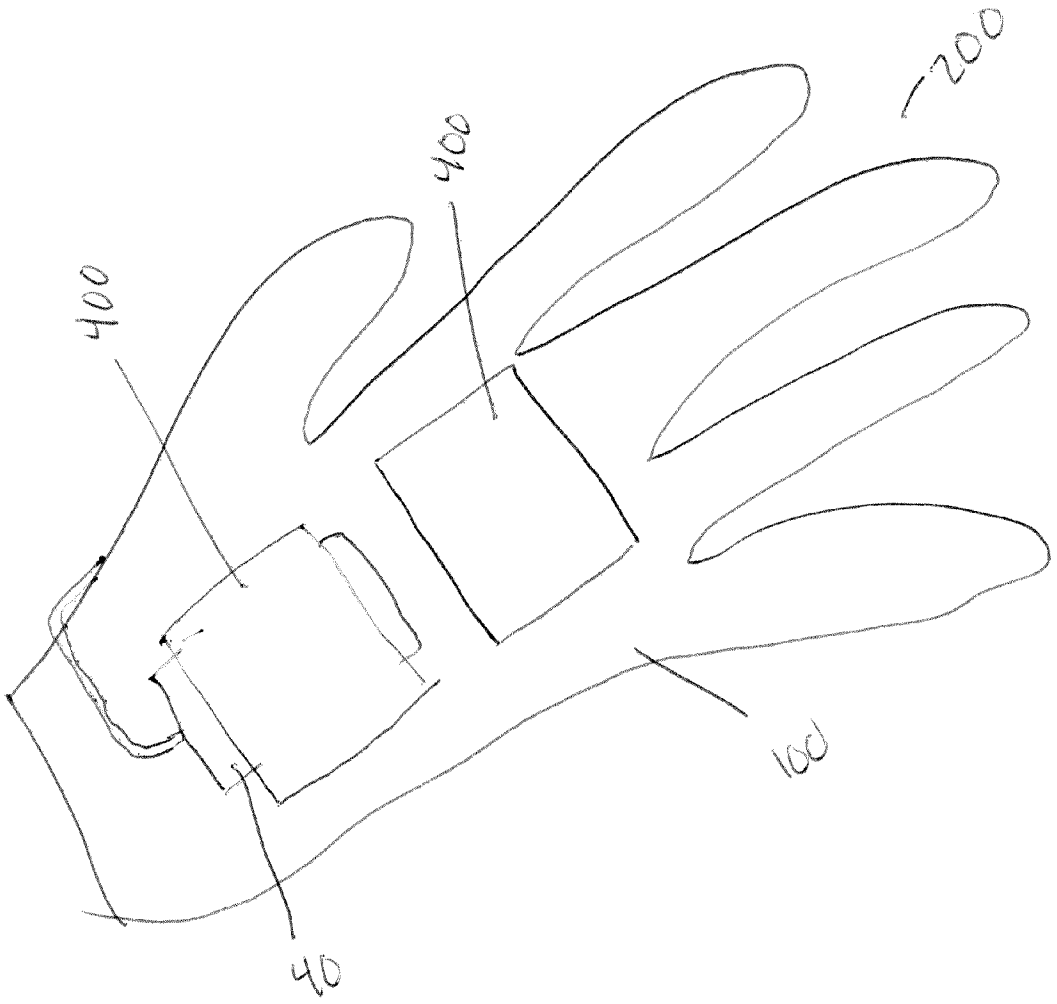
FIG. 12 shows a bottom plan view of an exemplary embodiment of a glove defining pockets for holding a pressure sensor in a variety of desired positions on the glove.

In one exemplary embodiment, a pressure sensor which is in electrical communication with the light source may be selectively attached to the glove in different positions. For example, as shown in FIG. 10 a pressure sensor 40 may comprise Velcro which makes it possible to adhere the pressure sensor to the glove 100 in a variety of different positions. The glove may comprise material which permits the Velcro to cling to it, the glove may comprise Velcro surfaces, etc. FIG. 11*a* shows an exemplary embodiment of a pressure sensor 40 comprising Velcro being selectively connected to a glove 100 in a first position while FIG. 11*b* shows how the pressure sensor 40 comprising Velcro may be selectively connected to a glove 100 in a second position. A pressure sensor may also be selectively connected to a glove in a variety of positions via snapping, tying (the pressure sensor or glove could comprise ties), placed into one of a variety of pockets defined by the glove, etc. FIG. 12 shows an exemplary embodiment of a glove 100 defining a plurality of pockets 400 which may be utilized to selectively hold a pressure sensor 40 in a variety of positions.

In some exemplary embodiments, a pressure sensor 40 located on the palm of the glove 100 enables a user to quickly turn on the glove's light source 10 without interrupting the user's involvement in another activity. For example, a user of the glove 100 who is riding a bike could be able to activate the glove's light source 10 by applying a force to the glove's pressure sensor 40 by pushing the palm of his hand firmly against the bike's handle bar. Likewise, a user of the glove 100 who is using his gloved hand to carry or utilize a device could activate the glove's light source 10 by applying a force to the glove's pressure sensor 40 by firmly squeezing the device being held in his hand.

In a preferred exemplary embodiment, a pressure activated lighted glove 200 comprises a pressure sensor 40 that is capable of detecting an applied force and upon detecting the force is capable of sending a signal to the power source 30. In some embodiments, the signal could cause the power source 30 to send power to the light source 10 causing the light source 10 to exude light, but it could also cause the power source 30 to discontinue sending power to the light source 10 such that the light is turned off. Thus, in an exemplary embodiment a user of a pressure activated lighted glove 200 could turn the glove's light source 10 on and then off by applying consecutive forces to the pressure sensor 40. The signal sent by the pressure sensor 40 could be electronic but it could also be of another type such as a radio signal. In some exemplary embodiments, the signal sent from the pressure sensor 40 causes the light source 10 to exude light until the pressure sensor 40 sends a second signal. In other embodiments, the signal sent from the pressure sensor 40 causes the light source 10 to be activated for a predetermined period of time.

In another exemplary embodiment a pressure sensor 40 is capable of differentiating between the strength of applied forces. Based on the strength of the force applied, the pressure sensor 40 causes a certain message to be sent to the power source 30. Based on the message received from the pressure sensor 40, the power source 30 may be able to send a certain amount of energy to the light source 10. In one exemplary embodiment, the greater the force detected by the pressure sensor 40, the greater the power sent from the power source 30 to the light source 10 and the greater the intensity of light put out by the light source 10. In another exemplary embodiment, a pressure sensor 40 is capable of detecting applied forces and sending a message to the power source 30 based on whether or not the detected force falls within a certain range. For example, a pressure sensor 40 might be able to detect an applied force and determine that the force is not great enough to fall within the predetermined range required to send a signal to the power source 30.

A pressure activated lighted glove 200 further comprises a pressure sensor bypass means 50. In a preferred embodiment, the pressure sensor bypass means 50 enables the effective deactivation of the pressure sensor's 40 ability to turn the light source 10 on and off. In a preferred embodiment, the pressure sensor bypass means 50 comprises a three way switch connected to or housed within the attachment means 20. FIGS. 1, 2, 3, and 5 each show an exemplary embodiment of a pressure sensor bypass means 50 comprising a three way switch. The pressure sensor bypass means 50 could also be located on the glove 100 or on the light source 10. In a preferred embodiment, the pressure sensor bypass means 50 is a three way switch that has the following three settings: pressure activation, light on, and light off. When the switch is set to "pressure activation", the pressure sensor 40 can be used to turn the glove's light on and off. When the switch is set to "light on" the glove's light is activated independently of the pressure sensor 40. When the switch is set to "light off" the glove's light is deactivated and the only way to turn it on is to turn the switch to one of its other two settings. In some exemplary embodiments the pressure activated glove 200 has a pressure sensor bypass means 50 that is a switch with more or less than three settings. In other exemplary embodiments, the pressure sensor bypass means 50 comprises a plurality of buttons while in other embodiments the pressure sensor bypass means 50 is only a single button.

Figure 13:
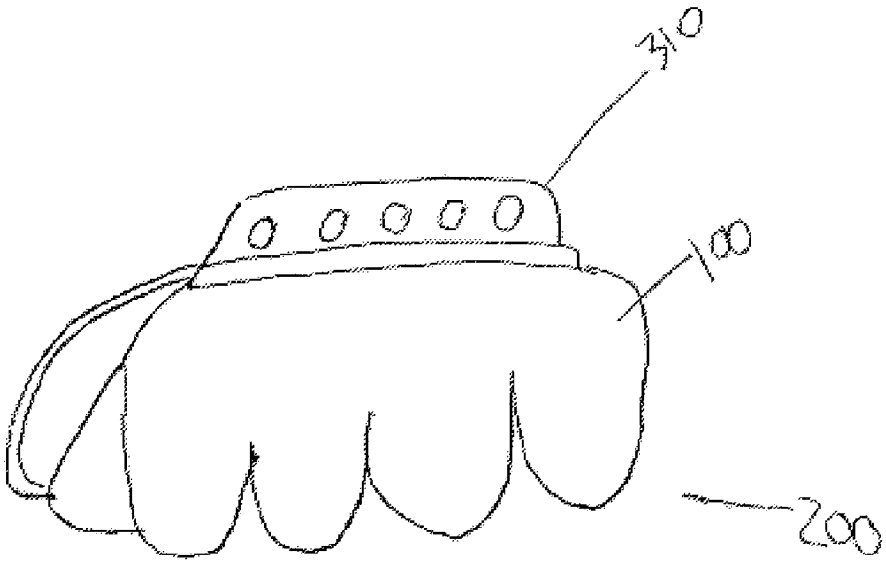
FIG. 13 shows a front plan view of a lighted glove comprising an exemplary embodiment of a moveable housing for directing a light beam.
Figure 14:
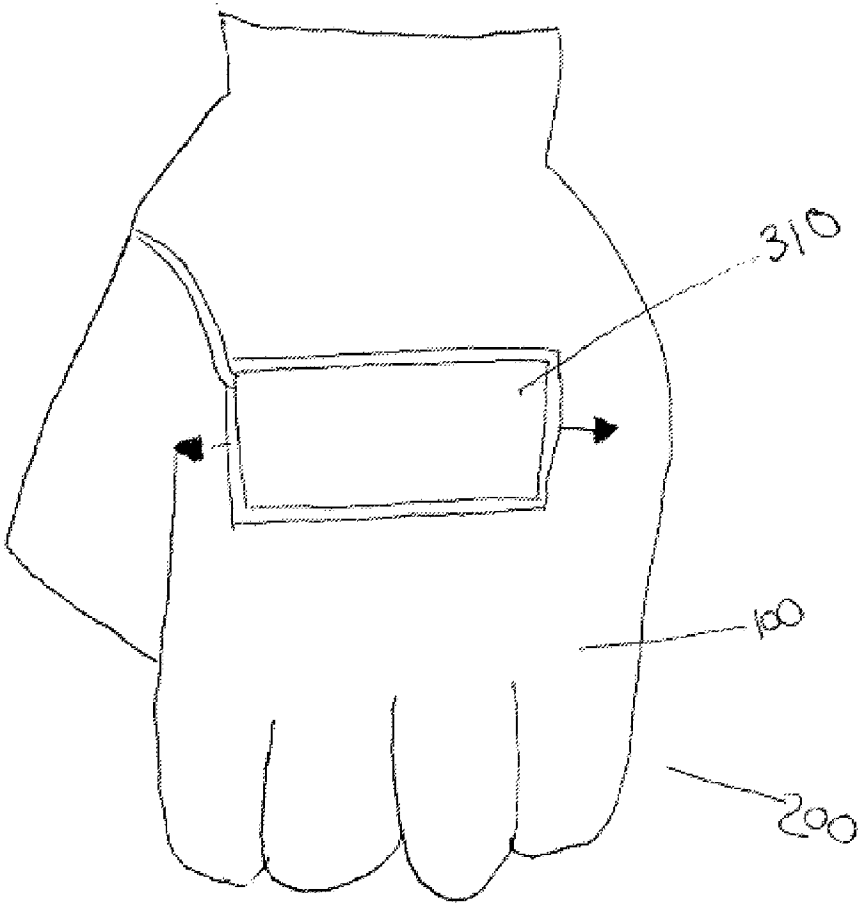
FIG. 14 shows a top plan view of the exemplary embodiment of FIG. 13 where the arrows show an exemplary motion path of the moveable housing for directing a light beam.
Figure 15:
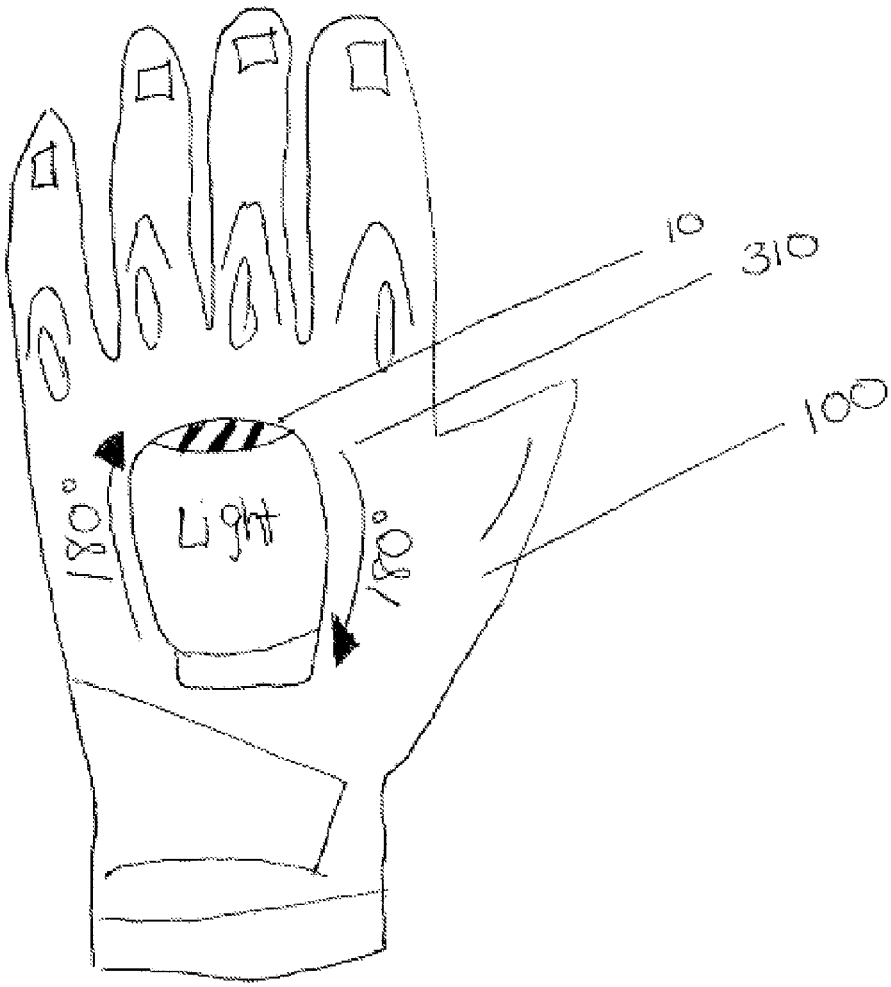
FIG. 15 shows a top plan view of an exemplary embodiment of a pivotal light beam directing means where arrows show an exemplary range of motion of the directing means.
Figure 16:
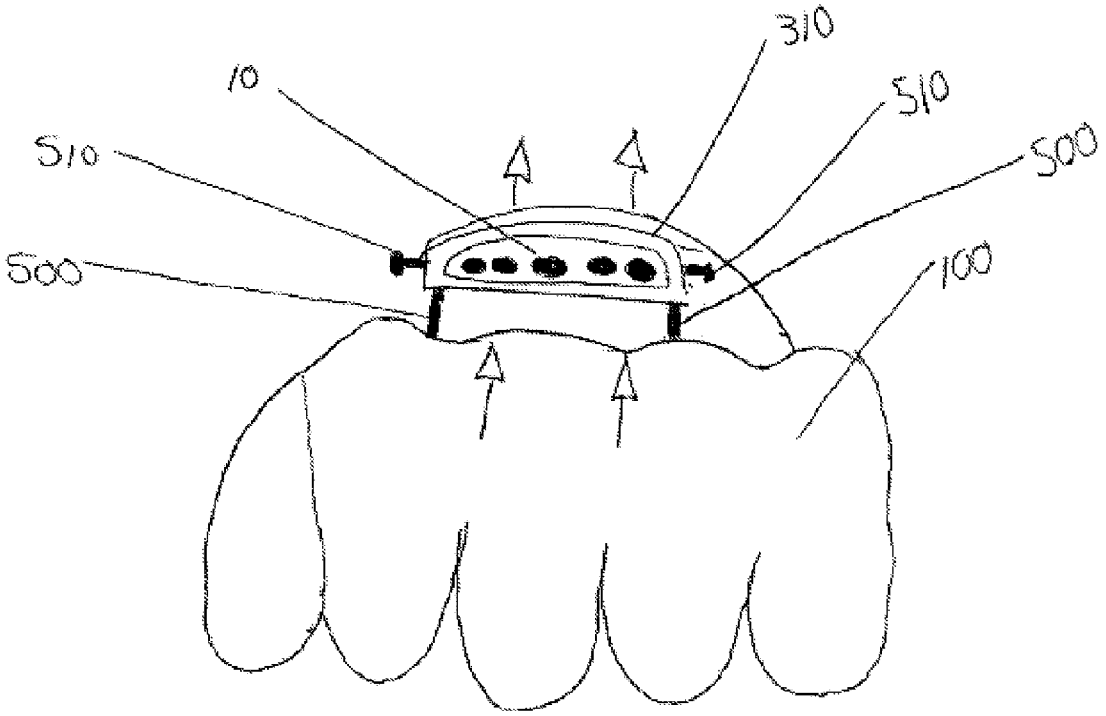
FIG. 16 shows a front plan view of an exemplary embodiment of a moveable housing that may be moved up and down where the housing comprises a post upon which the moveable housing may be moved and a securing means for securing the housing in a desired position on the post, arrows are shown to indicate an exemplary direction of movement of the housing.
Figure 17:
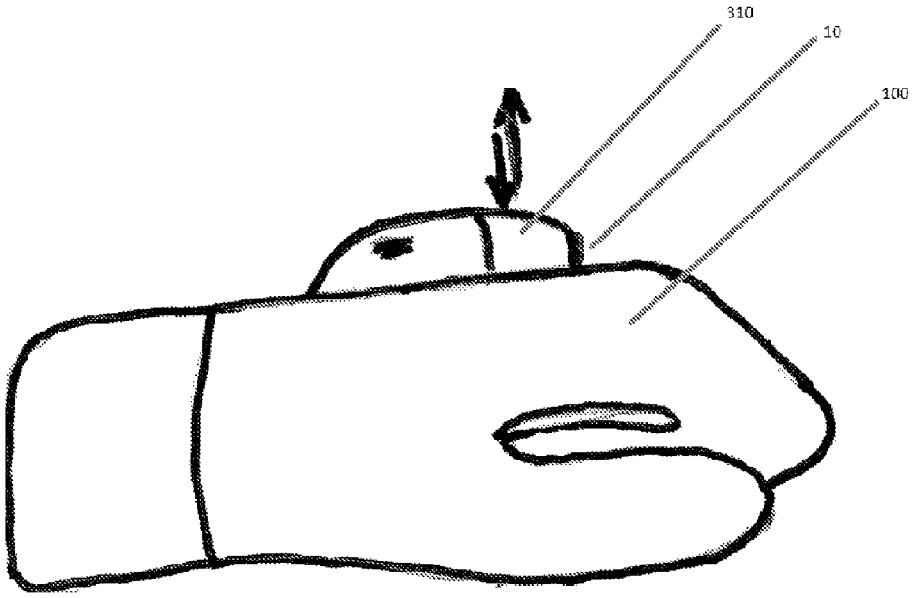
FIG. 17 shows a side plan view of a second exemplary embodiment of a moveable housing which may be moved up and down to change the direction of the emitted light where arrows are shown to indicate an exemplary direction of motion exhibited by the moveable housing.

Some exemplary embodiments may comprise a light source directing means 310. In some exemplary embodiments, such as that shown in FIG. 15 a light source directing means comprises a pivotal mount for the light source which permits the light source to be pivoted and the direction of the emitted light from the source to be changed. A light source directing means 310 may comprise a movable housing which defines at least one opening through which the light of the light source may shine when the moveable housing is positioned over the light source. FIG. 13 shows an exemplary embodiment of a movable housing 310 that may be utilized to direct the emitted light of a light source 10. In some exemplary embodiments, the movable housing 310 can be moved from side to side, up and down, etc. permitting a user of the glove to change the direction of the emitted light without moving the hand which is wearing the glove. As shown in FIG. 13 a moveable housing may define more than one opening through which the light from the light source may be emitted. In such exemplary embodiments, the opening through which the light is ultimately emitted preferably depends upon the position of the moveable housing 310. For example as shown in FIG. 14 a moveable housing may be moved from left to right and vice versa. Moving the moveable housing from a first position to a second position may cause the light of the light source to go from being emitted by a first opening defined by the moveable housing 310 to a second opening defined by the moveable housing 310 where the second opening directs the emitted light in a direction that is different than the direction in which the light was emitted by the first opening. FIG. 16 shows an exemplary embodiment of a moveable housing 310 that may be moved up and down in relationship to the glove 100 in order to alter the direction of the emitted light. As shown, the exemplary moveable housing 310 of FIG. 16 comprises at least one post 500 upon which the moveable housing moves up and down and a means for securing 510 the housing in a desired position on said post. FIG. 17 shows a second exemplary embodiment of a moveable housing which may be moved up and down in order to change the direction of the emitted light. In some exemplary embodiments a moveable housing may be moved left and right and up and down to change the direction of the emitted light. A movable housing 310 may be permanently connected to the glove 100 but in some exemplary embodiments the movable housing 310 may be selectively connected to and disconnected from the glove 100. In some exemplary embodiments, an attachment means 20 may comprise a light source directing means 310.

In some exemplary embodiments, a lighted glove may comprise a Global Position System ("GPS") sensor. The GPS sensor is preferably in electrical communication with a power source. The power source may be a battery. The power source in electrical communication with the GPS sensor may be the same power source which powers the light of the glove, but in some exemplary embodiments the power source is a separate power source. In one exemplary embodiment, the GPS sensor comprises a means for sending out a signal (such as a radio signal) that may be detected by at least one cell phone tower. Preferably more than one cell phone tower detects the signal emitted by the GPS sensor. The cell phone towers detecting the signal may be able to detect the relative strength of the signal emitted by the GPS sensor and utilize that information to determine the relative location of the glove. In some exemplary embodiments, the cell phone towers send information regarding the detected GPS signal to a remote computer which utilizes the signal information to determine the location of the glove. When a glove comprises a GPS sensor, the GPS sensor may permit the glove to be located by a remote device. For example, if an individual utilizing a glove with a GPS sensor becomes lost, a remote device may be able to track down the glove via the GPS sensor and thereby find the individual wearing the glove. In some exemplary embodiments a GPS sensor which emits a signal is housed by the attachment means which attaches a light source 10 to the glove 100.

The exemplary embodiments herein disclosed are not intended to be exhaustive or to unnecessarily limit the scope of the invention. The exemplary embodiments disclosed were chosen and described in order to explain the principles of the invention so that others skilled in the art may practice the invention. Having shown and described exemplary embodiments of the invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A device for providing a light source capable of one-handed operation comprising:

a glove;

an infra red light source;

a means for selectively attaching the light source to the glove;

a power source in electrical communication with the light source;

a pressure sensor attached to the glove and in electrical communication with the light source for activating and deactivating the light source; and a pressure sensor bypass means in electrical communication with the pressure sensor for selectively disabling said pressure sensor's ability to activate and deactivate said light source.

2. The device of claim 1 wherein said glove is a tactical glove.

3. The device of claim 1 wherein said pressure sensor bypass means comprises a three way switch.

4. The device of claim 1 wherein said pressure sensor comprises a pad-shaped device located on the palm of said glove.

5. The device of claim 1 wherein the attachment means comprises a casing which provides for the docking of the light source onto the glove.

6. The device of claim 1 further comprising a light beam directing means connected to said glove where said directing means defines at least one opening through which the light source may shine light when it has been activated.

7. The device of claim 6 where said light beam directing means comprises a moveable housing where the direction of the light emitted from the housing is altered by moving a portion of the housing in a clockwise or counterclockwise direction.

8. The device of claim 1 further comprising:

a radio signal transmitter in communication with said pressure sensor; and a radio signal receiver in communication with said power source.

9. The device of claim 1 further comprising:

an electrical wire connecting said pressure sensor to said power source.

10. A device for providing a light source capable of one-handed operation comprising:

a glove;

an infra red light source;

a casing that houses the light source and is attached to said glove;

a power source in electrical communication with the light source;

a pressure sensor attached to the glove for activating and deactivating the light source;

an electrical wire connecting said power source to said pressure sensor; and a means for temporarily disabling the pressure sensor wherein said disabling means is in electrical communication with said pressure sensor.

11. The device of claim 10 where the power source comprises:

a battery; and housing for said battery.

12. The device of claim 10 where the disabling means comprises a three way switch.

13. The device of claim 10 where the power source comprises a solar cell.

14. The device of claim 10 where the power source is rechargeable.

15. A device for providing a light source capable of one-handed operation comprising:

a glove;

a power source attached to the glove;

an infra red light selectively connected to the glove such that the light is in electrical communication with the power source;

a pressure sensor for activating and deactivating the light source wherein said pressure sensor is in electrical communication with the power source;

means for selectively attaching the pressure sensor to the glove in a variety of positions; and a pressure sensor bypass means for disabling said pressure sensor's ability to activate and deactivate said light source.

16. The device of claim 15 further comprising;

a second pressure sensor; and an electrical wire extending from the second pressure sensor to the power source.

17. The device of claim 15 where said means for attaching the pressure sensor to the glove in a variety of positions comprises hook and loop fastener.

18. The device of claim 15 further comprising a means for recharging the power source.

19. The device of claim 15 where said glove defines at least one pocket for selectively holding the pressure sensor in a desired position on the glove.

* * * * *